US010660487B1

(12) United States Patent
Borja

(10) Patent No.: US 10,660,487 B1
(45) Date of Patent: May 26, 2020

(54) HAIR DRYER MOUNTABLE BETWEEN SPACED APART WALL PANELS

(71) Applicant: Gregory Borja, El Portal, FL (US)

(72) Inventor: Gregory Borja, El Portal, FL (US)

( * ) Notice: Subject to any disclaimer, the term of this patent is extended or adjusted under 35 U.S.C. 154(b) by 0 days.

(21) Appl. No.: 15/877,541

(22) Filed: Jan. 23, 2018

(51) Int. Cl.
*A47K 10/48* (2006.01)
*A45D 20/08* (2006.01)

(52) U.S. Cl.
CPC ..... *A47K 10/48* (2013.01); *A45D 20/08* (2013.01); *A47K 2201/02* (2013.01)

(58) Field of Classification Search
CPC .... A47K 10/48; A47K 2201/02; A45K 20/08; F26B 19/00; F26B 21/06
USPC ..... 34/86, 96–100
See application file for complete search history.

(56) References Cited

U.S. PATENT DOCUMENTS 3,621,199 A 11/1971 Goldstein
4,756,094 A 7/1988 Houck, Jr.
4,780,595 A 10/1988 Alban
4,857,705 A 8/1989 Blevins
4,871,900 A 10/1989 Hickman
4,961,272 A 10/1990 Lee
5,007,182 A 4/1991 Fishman et al.
5,099,587 A 3/1992 Jarosch
5,103,577 A 4/1992 Michaels et al.
5,269,071 A 12/1993 Hamabe et al.
5,377,424 A 1/1995 Albanes
5,394,620 A 3/1995 Chimera
5,651,189 A 7/1997 Coykendall et al.
5,752,326 A 5/1998 Trim
5,839,205 A * 11/1998 Hung ..... F04D 17/165 34/97
5,873,179 A 2/1999 Gregory et al.
5,875,562 A * 3/1999 Fogarty ..... A45D 20/10 34/97
5,930,912 A 8/1999 Carder
6,131,303 A 10/2000 Roper
6,148,539 A 11/2000 Hatfield et al.
6,349,484 B1 2/2002 Cohen
6,718,650 B2 4/2004 Ross
6,739,071 B2 * 5/2004 Andis ..... A45D 20/122 239/456
7,900,371 B1 3/2011 Bullard
(Continued)

FOREIGN PATENT DOCUMENTS

GB 2545412 B * 6/2018 ..... A45D 20/12
WO WO-2017098200 A1 * 6/2017 ..... A45D 20/12

*Primary Examiner* — Stephen M Gravini
(74) *Attorney, Agent, or Firm* — Glenn E. Gold, P.A.; Glenn E. Gold

(57) ABSTRACT

A hair dryer and dryer system mountable between a pair of wall panels includes a hollow cylindrical housing having open inlet and outlet ends and a passageway extending therebetween, a group of co-operative components supported by the housing in communication with its passageway and co-operable to induce an inflow of unheated air into the housing open inlet end and an outflow of heated air from the housing open outlet end, a threadably adjustable annular coupler at the housing open inlet end, and an annular flange at the housing open outlet end. The annular coupler and annular flange together enable the housing to be disposed between and clamped respectively to the wall panels with the open inlet and outlet ends of the housing respectively occupying the first and second openings of the wall panels.

18 Claims, 12 Drawing Sheets

(56) References Cited

U.S. PATENT DOCUMENTS

| | | | | |
|---|---|---|---|---|
| 8,112,899 | B1 | 2/2012 | Duckworth | |
| 8,607,804 | B2 * | 12/2013 | De Benedictis | A45D 2/02 132/237 |
| 9,498,039 | B2 * | 11/2016 | Matsui | H01T 23/00 |
| 9,615,702 | B2 | 4/2017 | Calpe Gargallo | |
| 10,143,284 | B2 * | 12/2018 | Depoyian | A45D 20/50 |
| 10,143,285 | B2 * | 12/2018 | Stephens | A45D 20/122 |
| 10,226,112 | B2 * | 3/2019 | Kerr | A45D 20/10 |
| 2004/0159001 | A1 | 8/2004 | Ross | |
| 2005/0086735 | A1 | 4/2005 | Lim | |
| 2006/0021248 | A1 | 2/2006 | Symons | |
| 2008/0285963 | A1 | 11/2008 | Hendrikse et al. | |
| 2015/0343166 | A1 | 12/2015 | Ryu et al. | |

* cited by examiner

HAIR DRYER MOUNTABLE BETWEEN SPACED APART WALL PANELS

FIELD OF THE INVENTION

The present invention relates to hair drying flexibility, and more particularly, is concerned with a hair dryer mountable between spaced apart wall panels.

BACKGROUND OF THE INVENTION

Hair drying typically requires the use of one or both hands: at least one hand to hold a portable hair dryer with an electrical cord plugged into a wall outlet; and possibly the other hand to concurrently manipulate the position of the electrical cord during the drying process. This requirement makes it particularly difficult for women to perform other essential tasks concurrently with hair drying, for instance, styling the hair may take both hands to carry out.

Accordingly, there remains a need in the art for an innovation that will overcome the deficiencies of the known art and the problems that remain unsolved.

SUMMARY OF THE INVENTION

The present invention is directed to an innovation that overcomes the deficiencies of the known art and the problems that remain unsolved by providing a hair dryer mountable between spaced apart wall panels to free both hands of a user to perform other tasks concurrently with hair drying.

In one aspect of the present invention, a hair dryer, mountable between a pair of wall panels, includes:

- a housing having a hollow cylindrical configuration, opposite open inlet and outlet ends, and a passageway extending therebetween;
- a group of co-operative components supported by the housing in communication with the passageway and being co-operable to induce an inflow of unheated air into the open inlet end of said housing and produce an outflow of heated air from the open outlet end of the housing;
- an annular coupler capable of threadable adjustment along the open inlet end of the housing and forming an abutting relationship with the exterior of one of the wall panels surrounding a first opening of the one wall panel; and
- an annular flange affixed at the open outlet end of the housing and capable of forming an abutting relationship with the exterior of the other wall panel surrounding the second opening of the other wall panel;
- wherein threading the annular coupler along the open inlet end of the housing enables the annular coupler and the annular flange together to dispose and clamp the housing between and respectively to one and the other of the wall panels with the open inlet and outlet ends occupying the first opening of the one wall panel and the second opening of the other wall panel.

In another aspect of the present invention, the group of co-operative components include:

- a rotary fan peripherally mounted to the housing;
- a drive motor centrally and drivingly coupled to the rotary fan, the rotary fan and the drive motor together centrally located in the passageway of the housing;
- a pair of electric heating coils respectively located in the passageway of the housing in spaced apart relationships between one of the opposite open inlet and outlet ends of the housing and a corresponding one of opposite faces of the rotary fan; and
- a plurality of electrical components supplying electrical power to the drive motor and the pair of electric heating coils.

In another aspect of the present invention, the hair dryer also includes a nozzle of a hollow configuration coupled to the open outlet end of the housing through which flows the outflow of heated air from the open outlet end of the housing. The nozzle has a tapered outer portion that directs and concentrates the outflow of heated air from the nozzle. The nozzle and the open outlet end of the housing have complementary arcuate-shaped annular portions that permit the nozzle to be swiveled relative to the housing to vary the direction of outflow of heated air.

In another aspect of the present invention, a hair dryer, mountable between a pair of wall panels, includes:

- a housing having a hollow cylindrical configuration, opposite open inlet and outlet ends, and a passageway extending therebetween;
- a group of co-operative components supported by the housing in communication with the passageway and being co-operable to induce an inflow of unheated air into the open inlet end of said housing and produce an outflow of heated air from the open outlet end of the housing;
- an annular coupler including
  - a male threaded section defined on the housing externally about the open inlet end thereof, and
  - a rotatable annular flange having
    - an annular body,
    - an outer annular rim on the annular body capable of forming an abutting relationship with the exterior of one of the wall panels surrounding a first opening in the one wall panel, and
    - a female threaded section formed internally on the annular body and configured to thread along the male threaded section on the open inlet end of the housing to bring the outer annular rim into the abutting relationship with the one wall panel;
- an annular flange affixed at the open outlet end of the housing and capable of forming an abutting relationship with the exterior of the other wall panel surrounding a second opening of the other wall panel; and
- a nozzle of a hollow configuration coupled to the open outlet end of the housing through which flows the outflow of heated air from the open outlet end of the housing, the nozzle and the open outlet end of the housing having complementary arcuate-shaped annular portions that permit the nozzle to be swiveled relative to the housing to vary the direction of outflow of heated air;
- wherein threading the female threaded section of the annular coupler along the male threaded section of the open inlet end of the housing enables the annular coupler and the annular flange together to dispose and clamp the housing between and respectively to one and the other of the wall panels with the open inlet and outlet ends occupying the first opening of the one wall panel and the second opening of the other wall panel.

In another aspect of the present invention, a hair dryer, mountable between a pair of wall panels, includes:

- a housing having a hollow cylindrical configuration, opposite open inlet and outlet ends, and a passageway extending therebetween;
- a group of co-operative components supported by the housing in communication with the passageway and being co-operable to induce an inflow of unheated air into the open inlet end of the housing and produce an outflow of heated air from the open outlet end of the housing;

an annular coupler including a male threaded section defined on the housing externally about the open inlet end thereof, and a rotatable annular flange having an annular body, an outer annular rim on the annular body extending radially outward from the annular body so as to form an annular planar surface that faces toward and is capable of forming an abutting relationship with the exterior of one of the wall panels surrounding a first opening in the one wall panel, and a female threaded section formed internally on the annular body and configured to thread along the male threaded section on the open inlet end of the housing to bring the outer annular rim into the abutting relationship with the one wall panel;

an annular flange affixed at and extending radially outward from the open outlet end of the housing so as to form an annular planar surface that faces toward and is capable of forming an abutting relationship with the exterior of the other wall panel surrounding the second opening in the other wall panel;

a nozzle of a hollow configuration coupled to the open outlet end of the housing through which flows the outflow of heated air from the open outlet end of the housing, the nozzle and the open outlet end of the housing have complementary arcuate-shaped annular portions that permit the nozzle to be swiveled relative to the housing to vary the direction of outflow of heated air; and an adapter extension having an elongated flexible hose at one end configured to fit over said nozzle and a head at an opposite end from the one end with a handle affixed thereto to facilitate maneuvering of the head and the flexible hose to enable drying the hair of a person;

wherein threading the female threaded section of the annular coupler along the male threaded section of the open inlet end of the housing enables the annular coupler and the annular flange together to dispose and clamp the housing between and respectively to one and the other of the wall panels with the open inlet and outlet ends occupying the first opening of the one wall panel and the second opening of the other wall panel.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
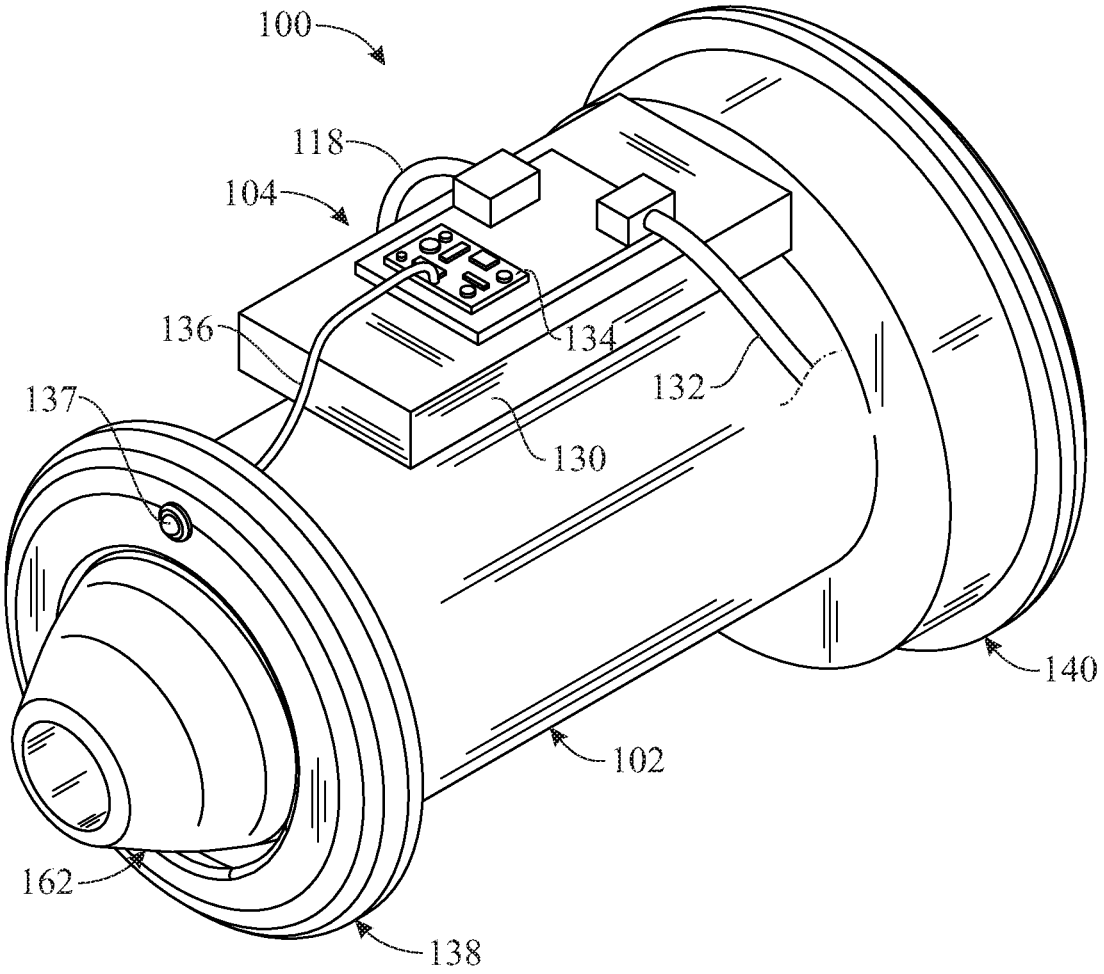
FIG. 1 presents a front isometric view of an exemplary embodiment of a hair dryer mountable between a pair of wall panels in accordance with aspects of the present invention, shown before being installed between the wall panels.
Figure 2:
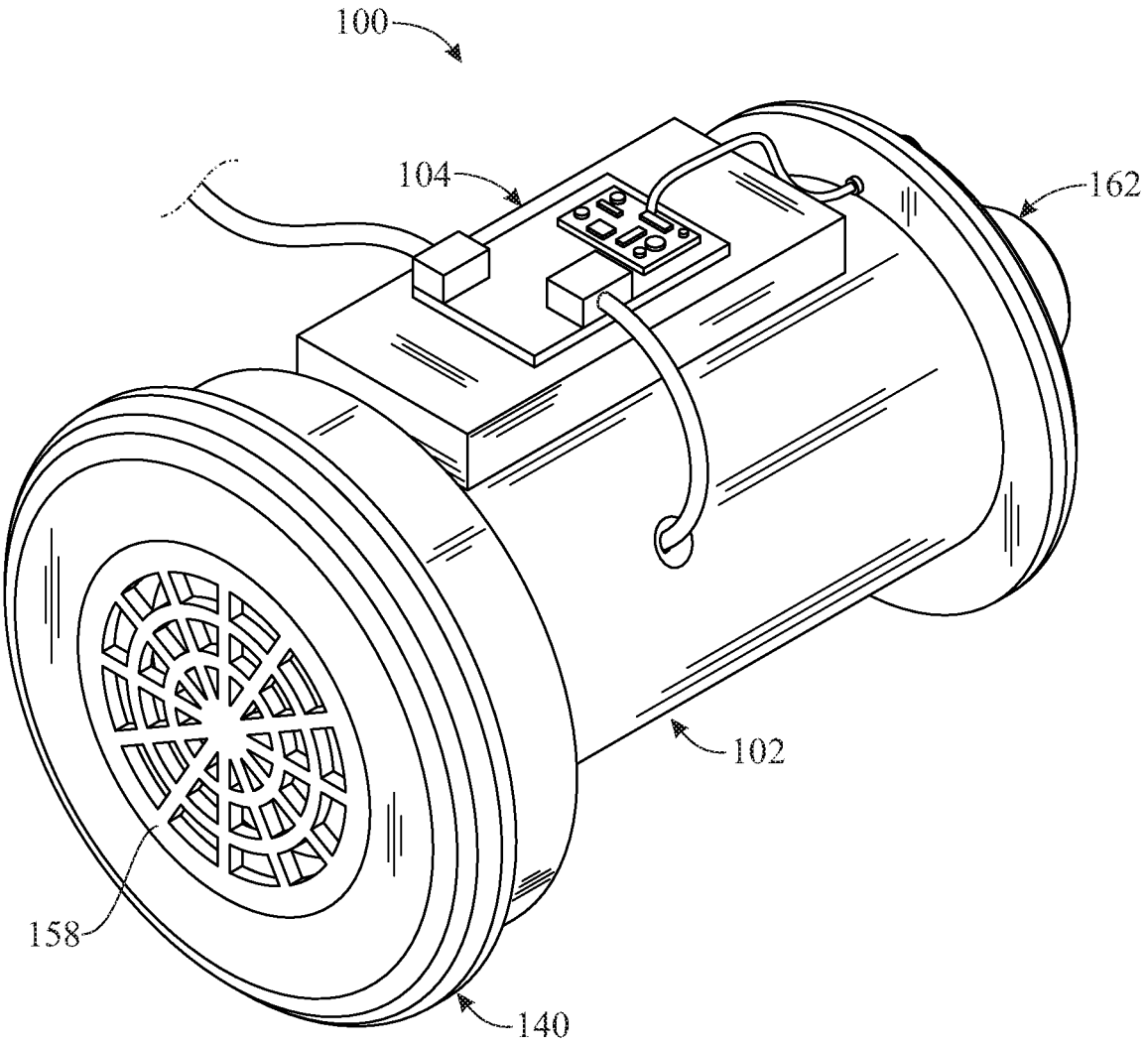
FIG. 2 presents a rear isometric assembled view of the hair dryer originally introduced in FIG. 1.
Figure 3:
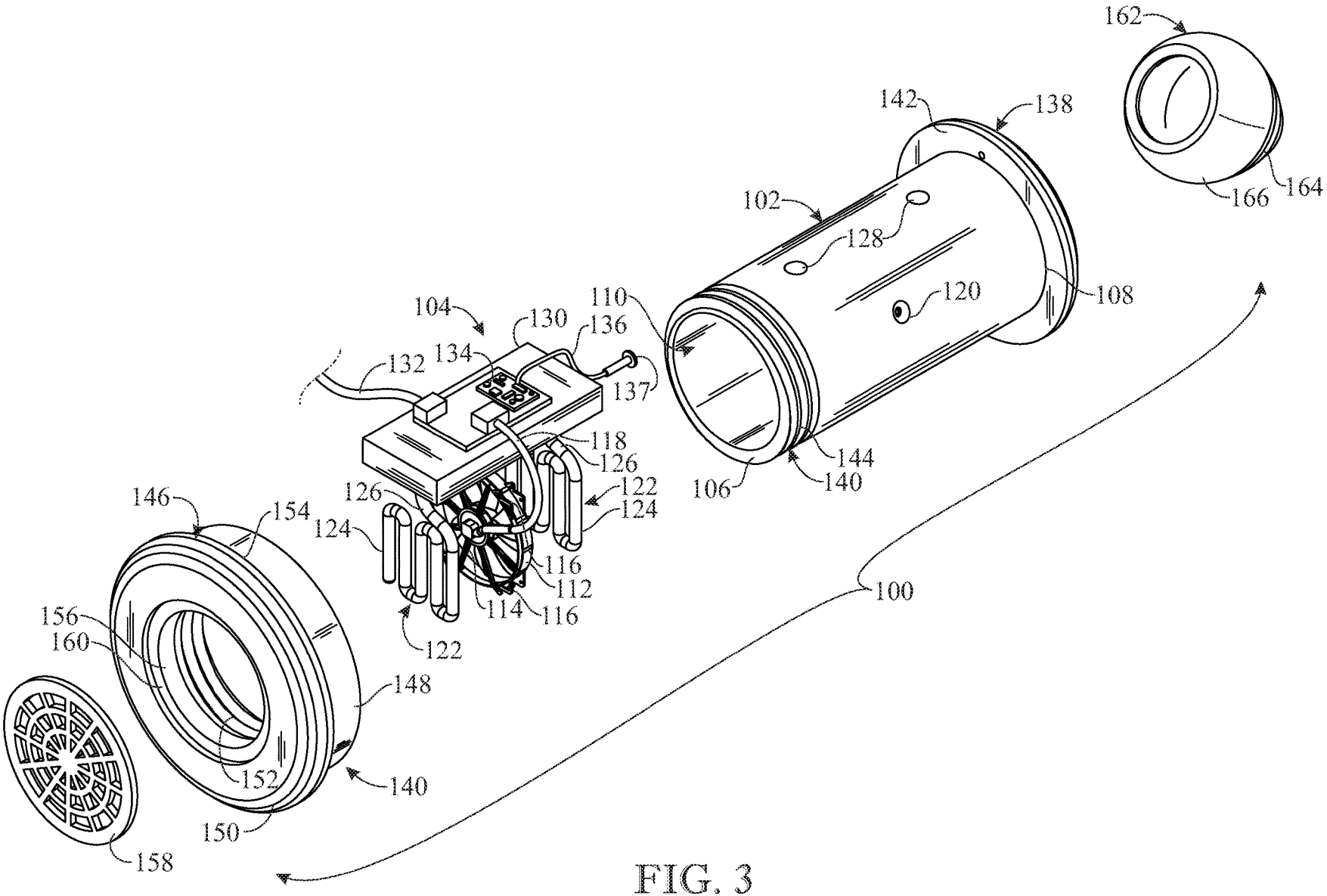
FIG. 3 presents a rear isometric exploded view of the hair dryer originally introduced in FIG. 1.
Figure 4:
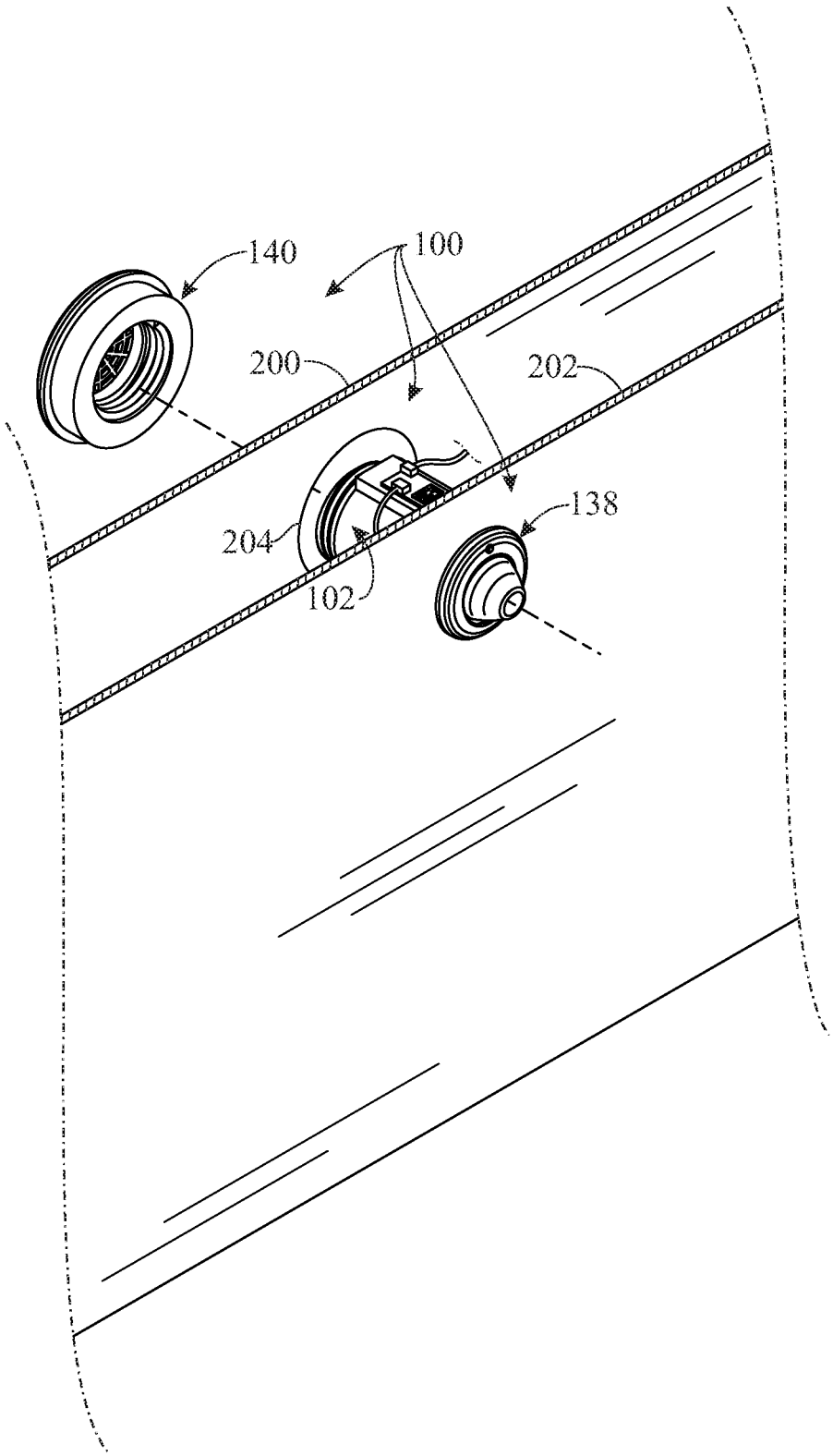
FIG. 4 presents a front isometric partially exploded view of the hair dryer partially installed between the wall panels.
Figure 5:
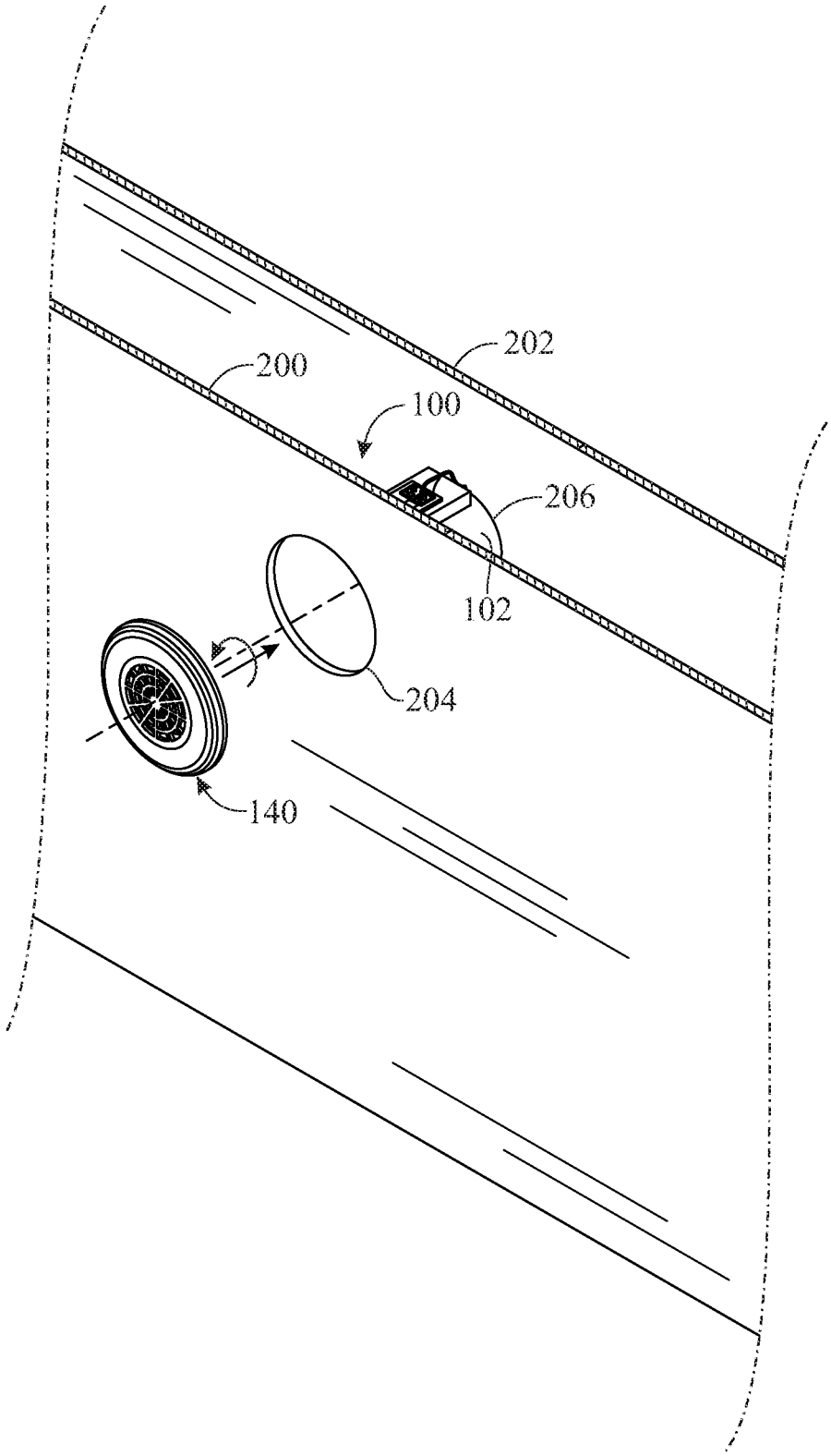
FIG. 5 presents a rear isometric partially exploded view of the hair dryer partially installed between the wall panels.
Figure 6:
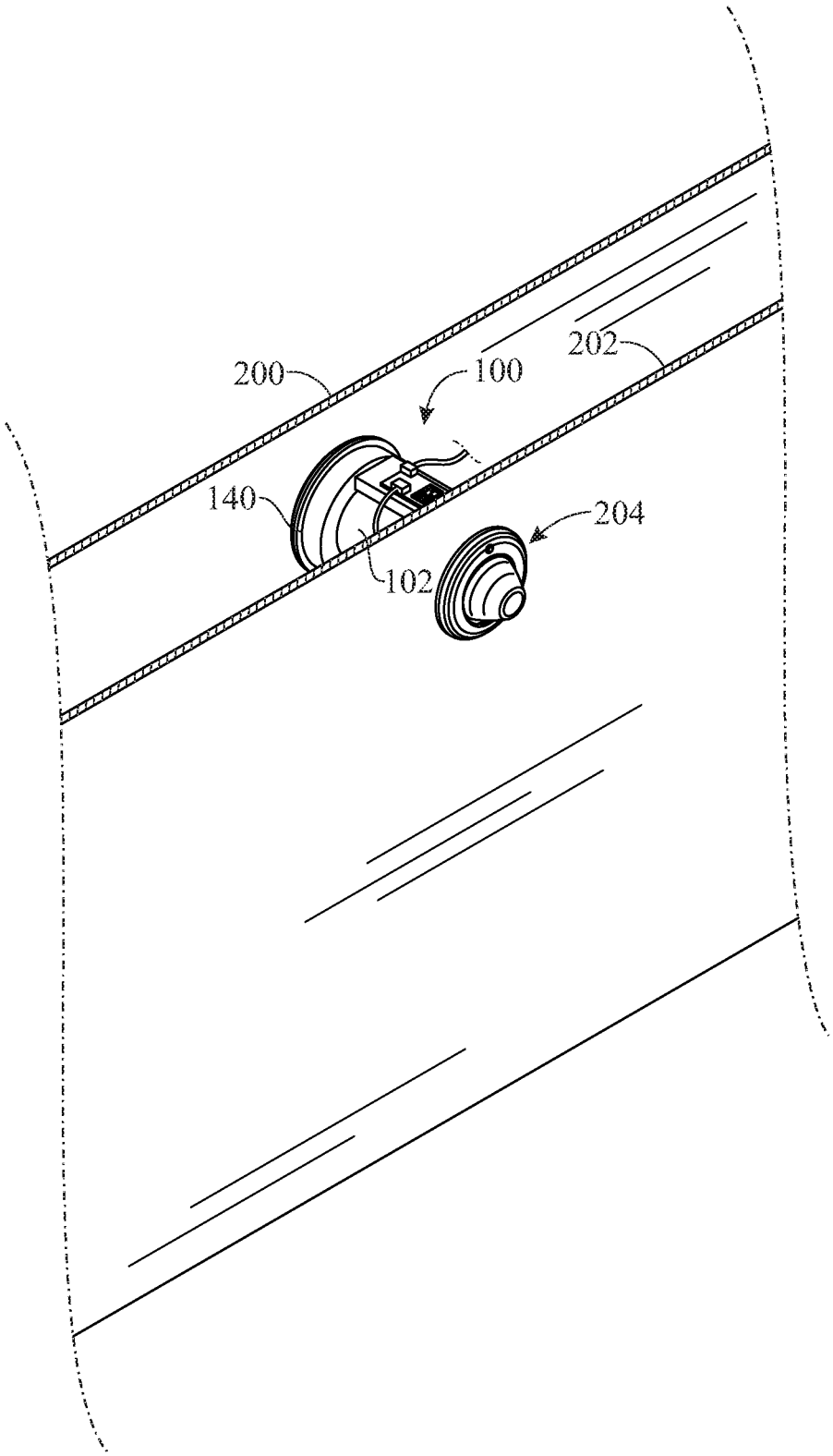
FIG. 6 presents a front isometric assembled view of the hair dryer after being installed between the wall panels.
Figure 7:
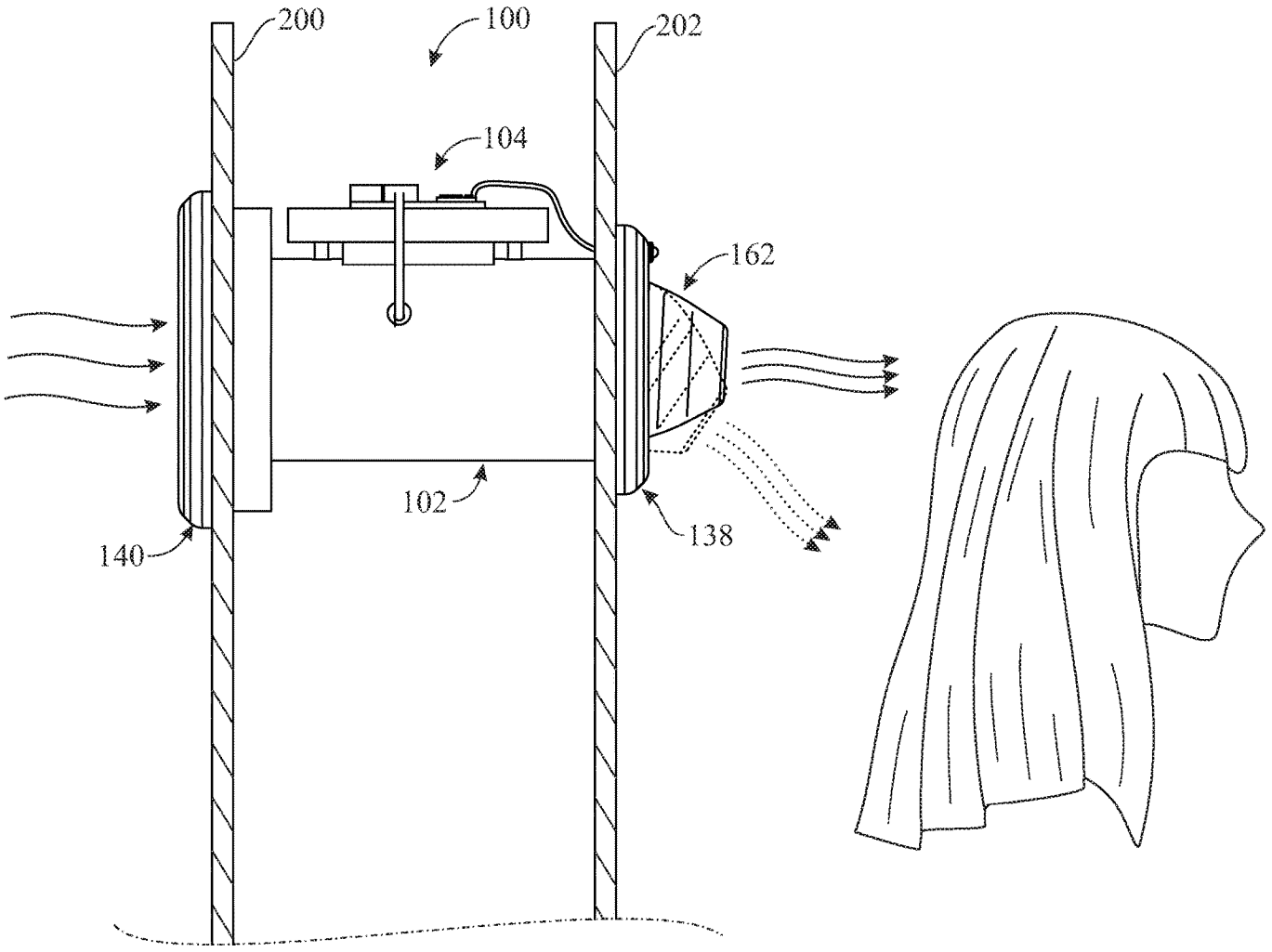
FIG. 7 presents a side elevation assembled view of the hair dryer installed between the wall panels as shown in FIG. 6.
Figure 8:
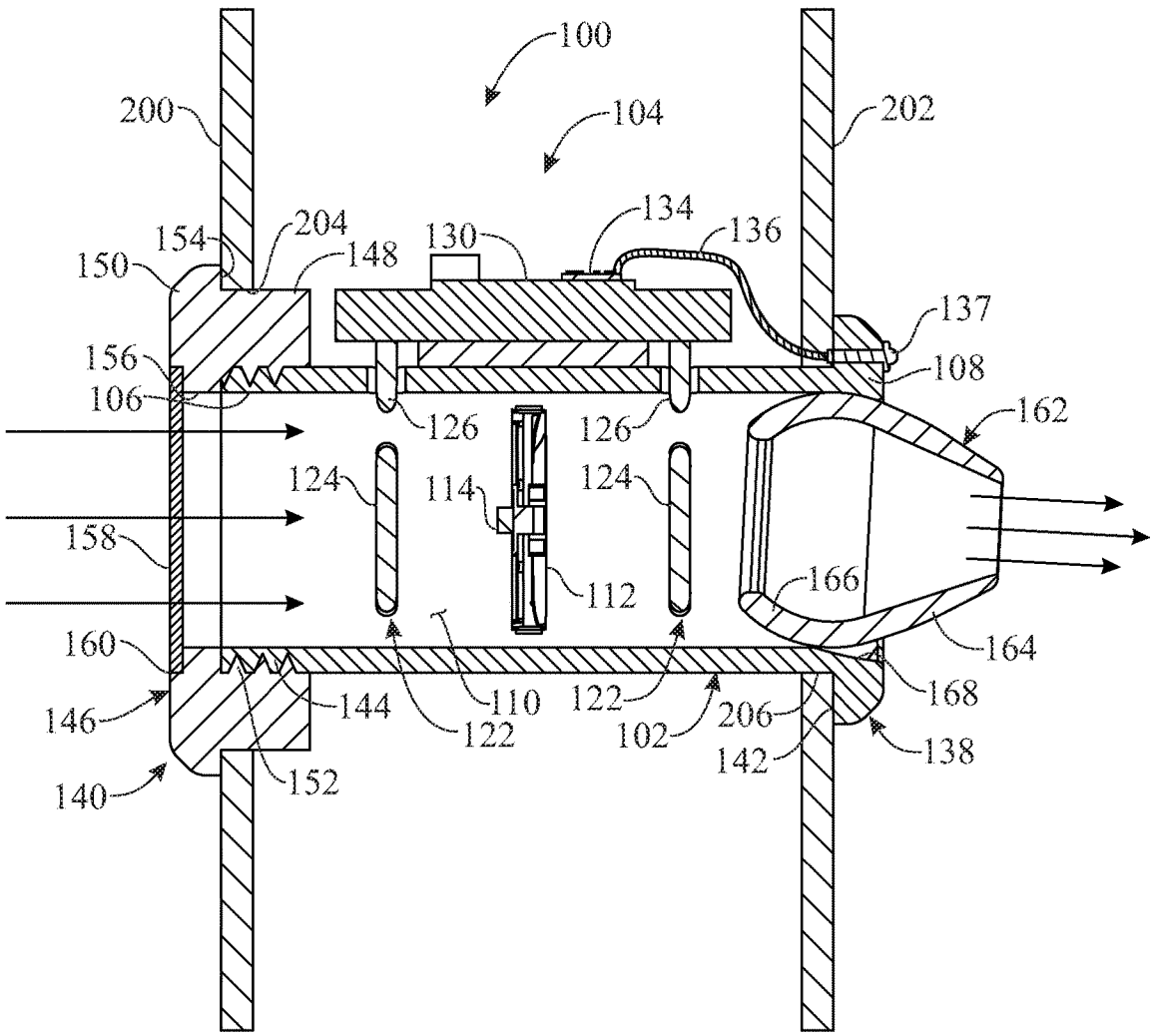
FIG. 8 presents a longitudinal sectional assembled view of the hair dryer installed between the wall panels.

Referring now to FIGS. 1-3, there is illustrated a hair dryer, generally designated 100, mountable between a pair of wall panels 200, 202, as shown in FIGS. 4-8, in accordance with aspects of the present invention. The wall panels 200, 202 have respective first and second openings 204, 206 disposed opposite from one another with the second opening 206 being larger in diameter than the first opening 204.

In FIGS. 1-3 the hair dryer 100 is shown before being installed or mounted between the wall panels 200, 202. The hair dryer 100 basically includes a casing or housing 102 of a hollow cylindrical configuration, and a group of co-operative components 104 being co-operable with one another and with the housing 102 to induce an inflow of unheated air into the housing and produce an outflow of heated air from the housing. The housing 102 may be made of a suitable metal or plastic. More particularly, the housing 102 has opposite open inlet and outlet ends 106, 108 and a passageway 110 extending between the open inlet and outlet ends. The spacing between the wall panels 200, 202 and the length of the housing 102 are such that its open inlet and outlet ends 106, 108 are respectively locatable proximate to the first and second openings 204, 206 in the respective wall panels. Also, the diameter size of each of the open inlet and outlet ends 106, 108 of the housing 102 is smaller than that of the first and second openings 204, 206 in the respective spaced apart wall panels 200, 202. The term "wall panels" is used herein in a generic sense in that the wall panels 200, 202 may be parts of any type of wall structure or any type of movable or stationary cabinet or other fixture or piece of furniture.

Referring to FIGS. 1-3, 7 and 8, the group of co-operative components 104 of the hair dryer 100 that are co-operable to induce an inflow of unheated air into the housing 102 and produce an outflow of heated air from the housing are coupled to one another and to the housing, the components being individually assembled to the housing by using well-known techniques that need not be described in detail herein. More particularly, the group of co-operative components 104 may include a rotary impeller or fan 112 and a drive motor 114 centrally and drivingly coupled thereto. The rotary fan 112 and drive motor 114 are together centrally located in the passageway 110 of the housing 102 between the opposite inlet and outlet ends 106, 108 thereof. The rotary fan 112 at spaced apart locations 116 about its periphery is mounted to the housing 102 in a conventional manner (not shown). The drive motor 114 has an electric power cord 118 connected thereto and extending therefrom through a side aperture 120 defined through the housing 102 at a central location thereon to one side of the rotary fan 112. The group of co-operative components 104 of the hair dryer 100 may also include a pair of electric heating coils 122 of the electrical resistive type disposed in the passageway 110. Each electric heating coil 122 includes a main portion 124 having a sinusoidal configuration. The main portions 124 are respectively located in spaced apart relationships between one of the opposite inlet and outlet ends 106, 108 of the housing 102 and a corresponding one of opposite faces of the rotary fan 112. An end portion 126 of each of the electric heating coils 122, being of an arcuate configuration, leads from a corresponding one of the main portions 124 through a corresponding one of a pair of spaced apart apertures 128 defined through the housing 102 at locations above and aligned with the electric heating coils 122 to a platform 130 supported on the upper exterior side of the housing 102. Electrical power is supplied from a source (not shown) by an electrical supply cord 132 connected to circuitry (not shown) within the interior of the platform 130 where the electrical power is distributed to the end portions 126 of the electric heating coils 122 and also via the electric power cord 118 to the drive motor 114 of the rotary fan 112. The group of co-operative components 104 of the hair dryer 100 may further include a circuit board 134 mounted on the platform 130 having elements that enable electrically managing the operation of the group of co-operative components 104, such as by an electric wire 136 leading from the circuit board 134 to an off/on switch 137 mounted at the exterior of the other wall panel 202 adjacent to the second opening 206 therein as well as adjacent to the open outlet end 108 of the housing 102, or by suitable remote control such as via a mobile application (i.e. Bluetooth) and a sensor (not shown) incorporated at the off/on switch.

Referring now to FIGS. 4-8, the housing 102 of the hair dryer 100 is configured to be mountable to and extendable between the wall panels 200, 202 by the incorporation of an annular flange 138 affixed at the open outlet end 108 of the housing and an annular coupler 140 capable of threadable adjustment along the open inlet end 106 of the housing. The annular flange 138 is attached about the outlet end 108 of the hollow housing 102 and extends radially outward therefrom so as to form an annular planar surface 142 that faces toward and is capable of forming an abutting relationship with the exterior of the other wall panel 202 where it surrounds the second opening 206 of the other wall panel 202. The annular coupler 140 includes a male threaded section 144 defined in the housing 102 externally about the open inlet end 106 thereof, and a rotatable annular flange 146 threadably adjustable on the male threaded section 144. The rotatable annular flange 146 has an annular body 148, an outer annular rim 150 on the annular body, and a female threaded section 152 on the annular body. The outer annular rim 150 is defined externally about and extends radially outward from an outer portion of the annular body 148 so as to form an annular planar surface 154 that faces toward and is capable of abutting the exterior of the one wall panel 200 where it surrounds the first opening 204 of the one wall panel 200. The female threaded section 152 is defined internally about the annular body 148 of the rotatable annular flange 146 and configured to thread onto and along the male threaded section 144 on the inlet end 106 of the housing 102. The rotatable annular flange 146 also has a central opening 156 that forms an extension of the open inlet end 106 of the housing 102 and a circular grate 158 that fits into an annular recess 160 formed about the outer end of the central opening 156 of the rotatable annular flange 146.

The housing 102 may be disposed between the wall panels 200, 202 as follows: first, inserting the housing 102 at its inlet end 106 through the second opening 206 of the other wall panel 202, second, moving the housing 102 across the space between the wall panels 200, 202; and, third, inserting the housing 102 at its inlet end 106 into the first opening 204 of the one wall panel 200 until annular planar surface 142 on the annular flange 138 abuts the exterior of the other wall panel 202 surrounding the second opening 206 thereof. Once so disposed, the housing 102 may now be clamped to the wall panels 200, 202 by rotating annular flange 146 so as to thread its female threaded section 152 onto and along the male threaded section 152 on the open inlet end 106 of the housing 102 until the annular planar surface 154 on the outer annular rim 150 of the rotatable annular flange 146 abuts the exterior of the one wall panel 200 where it surrounds the first opening 204 of the one wall panel. The housing 102 is now securely clamped to the wall panels 200, 202 between the annular planar surface 154 on the outer annular rim 150 of the rotatable annular flange 146 and the annular planar surface 142 on the annular flange 138 at the open outlet end 108 of the housing.

Referring again to FIGS. 1, 3, 4 and 6-8, the housing 102 of the hair dryer 100 at its outlet end 108 is fitted with a nozzle 162 of hollow configuration through which flows the outflow of heated air exiting the outlet end 108 of the housing 102. The nozzle 162 has a tapered forward portion 164 that directs and concentrates the outflow of heated air from the nozzle. The nozzle 162 also has an arcuate-shaped annular rearward portion 166 that fits within a complementarily annular-shaped interior end portion 168 of the open outlet end 108 of the housing 102 so as to permit the nozzle 162 to be swiveled up-and-down and side-to-side relative to the open outlet end of the housing to vary the direction of the outflow of heated air.

Figure 9:
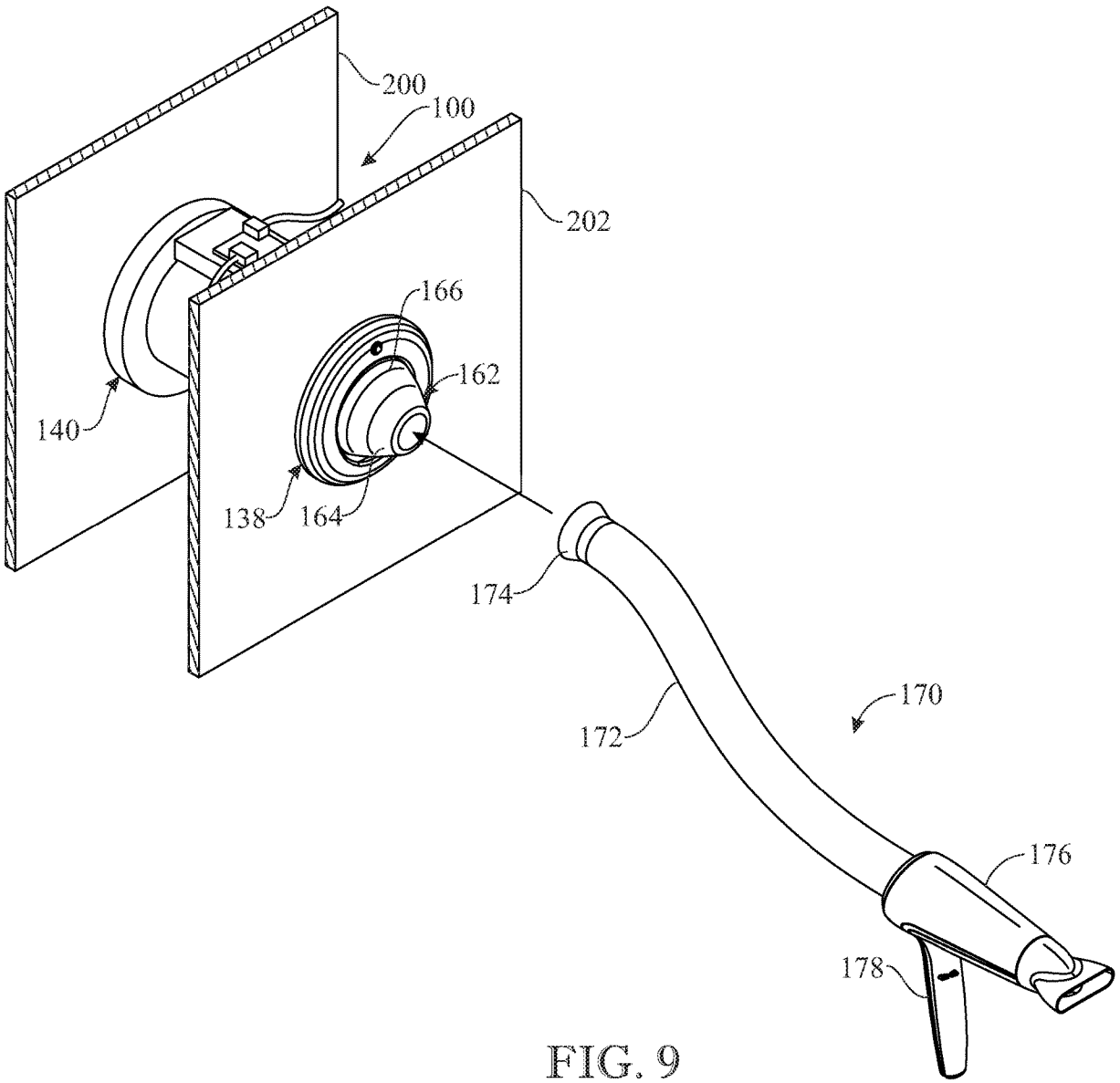
FIG. 9 presents a front isometric partially exploded view of the hair dryer installed between the wall panels as shown in FIGS. 6-8, illustrating an adapter hose extension before being installed on the hair dryer.
Figure 10:
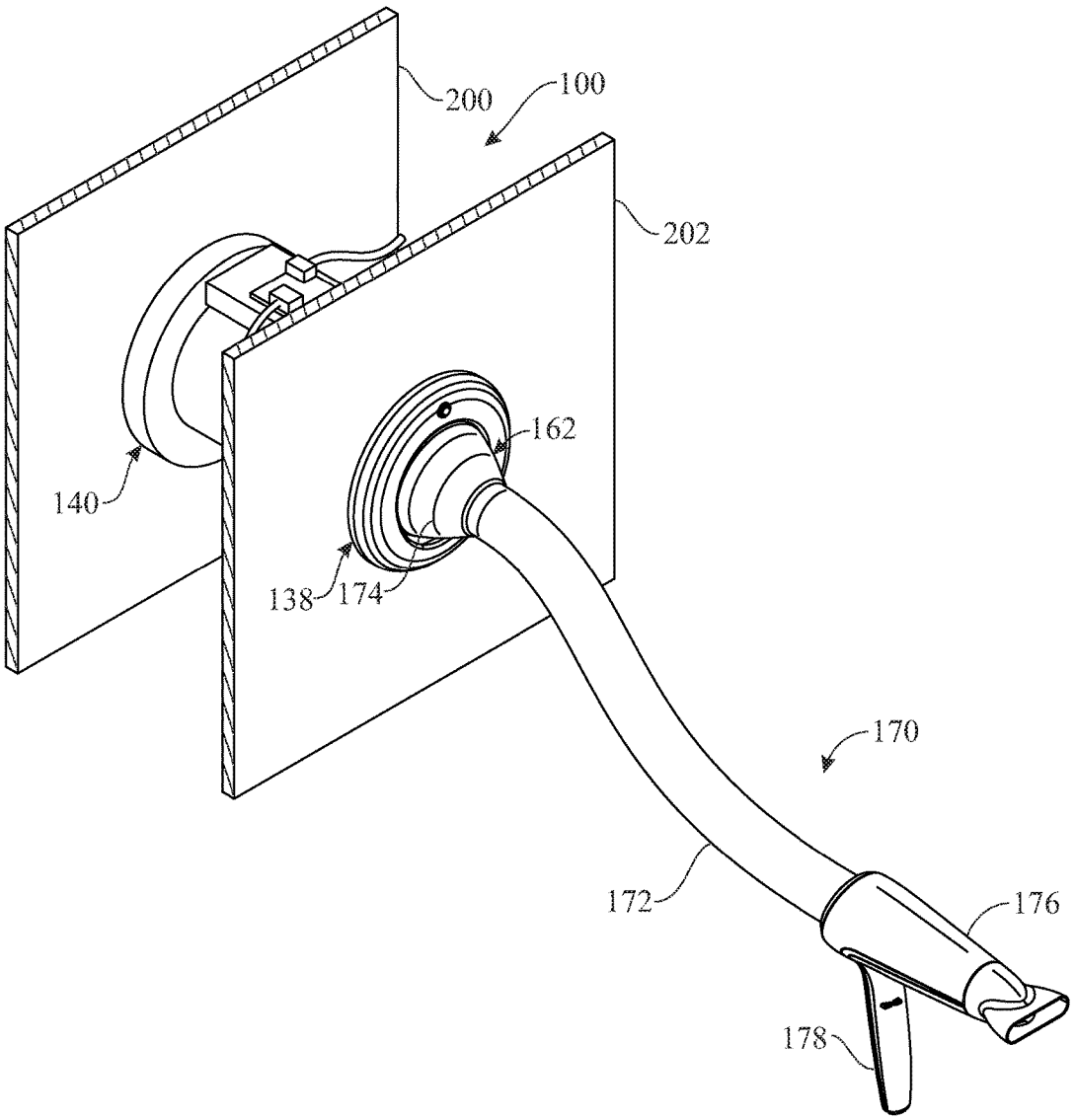
FIG. 10 presents a front isometric assembled view of the hair dryer, illustrating the adapter hose extension after being installed on the hair dryer.

Referring now to FIGS. 9 and 10, there is illustrated an adapter extension 170 for the hair dryer 100. The adapter extension 170 has an elongated flexible tube or hose 172 with a flared connector 174 at its rear end configured to snugly fit over the tapered exterior of the forward portion 164 of the nozzle 162. The flexible hose 172 at its front end has a hollow head 176 that further concentrates the heated airflow, and a handle 178 affixed to the head 176 that to facilitate manipulating or maneuvering of the head, such as by another person assisting in the drying of a person's hair.

Figure 11:
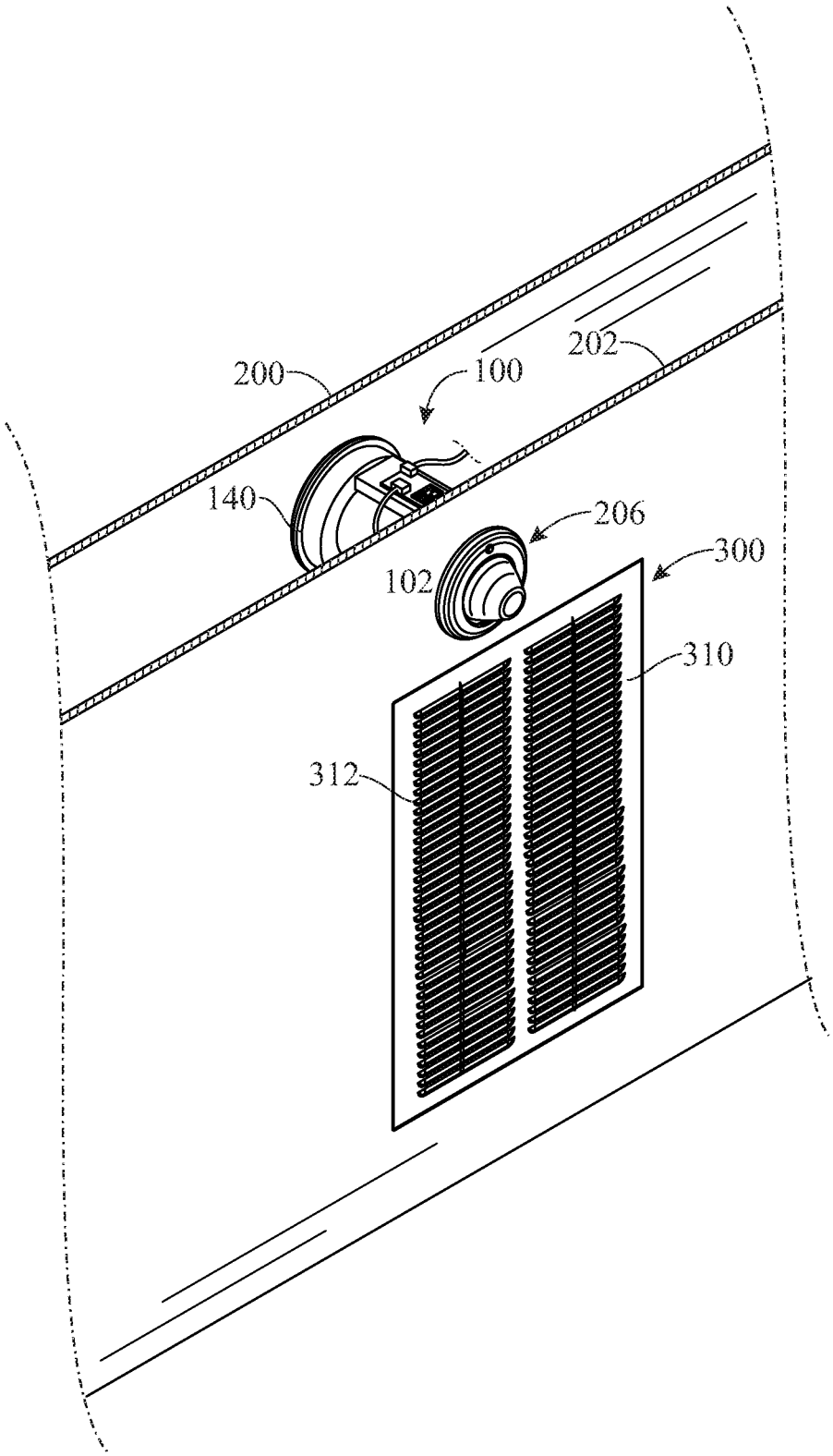
FIG. 11 presents a front isometric assembled view of an alternate hair dryer that is mountable between a pair of wall panels that includes a hair drying system and vent coupled to the hair dryer in accordance with aspects of the present invention.
Figure 12:
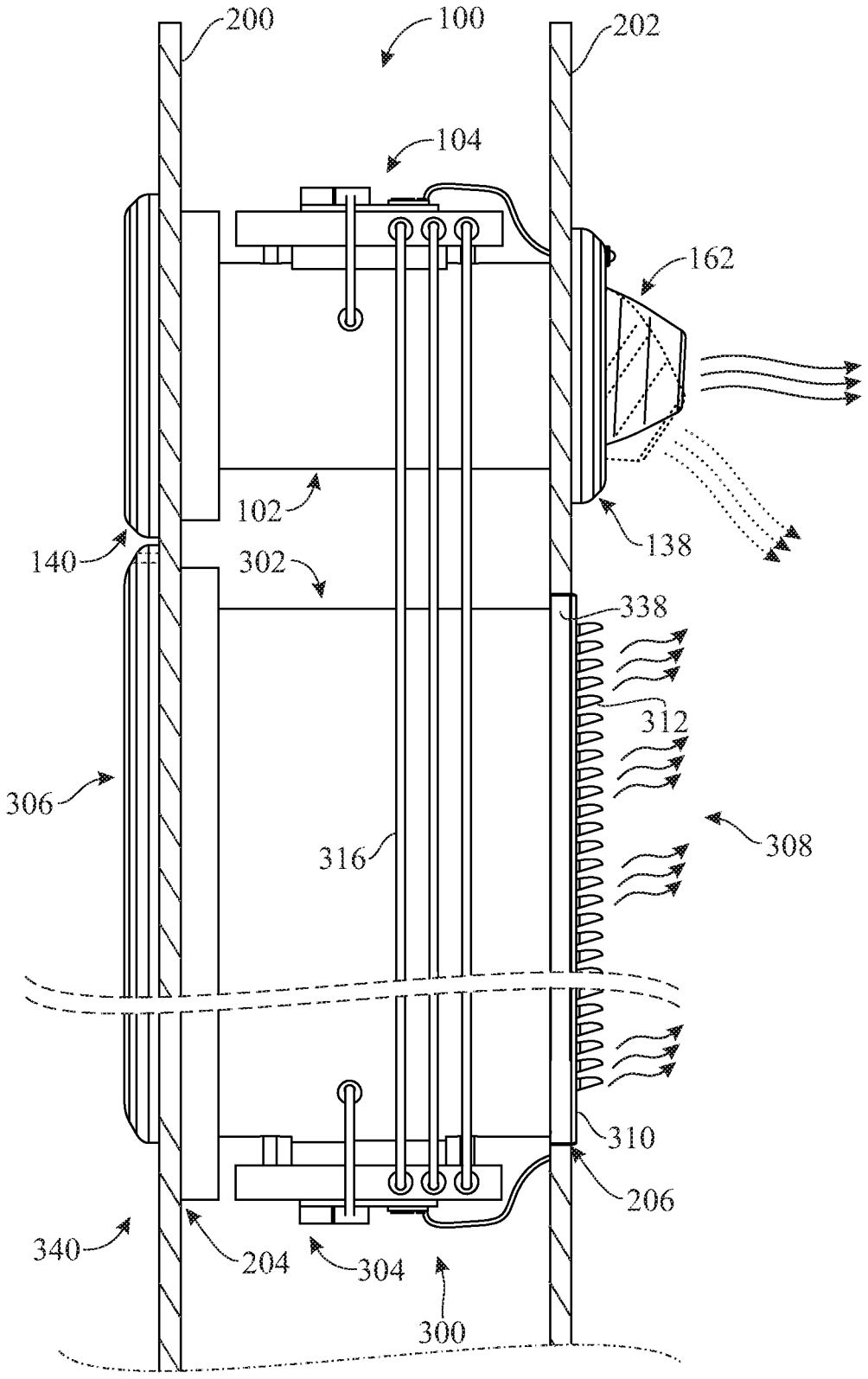
FIG. 12 presents a left side view of the hair dryer shown in FIG. 11, with the pair of wall panels sectioned to expose the operative hair drying system and vent.

Turning now primarily to FIGS. 11 and 12, an alternate implementation of the hair dryer 100 now in cooperative communication and coupled in series to a drying vent system 300 is generally shown. The system 300 and dryer 100 may be coupled in series or parallel by known electrical means, for example with wiring 316, such that each may be operated simultaneously or independently of one another based upon the user's preference. Features of the drying vent system that are similar to the corresponding features of the hair dryer 100, have been provided using similar reference numerals, except that the components of the drying vent system 300 have been numbered with the same-digit suffix preceded by the numeral "3." The features of the hair dryer 100 are the same as described herein above. Thus, for the sake of brevity they are not described herein below.

The drying vent system 300 is shown installed or mounted between wall panels 200, 202. The drying vent system 300 generally includes a casing or housing 302 of a rectangular configuration, and a group of co-operative components 304 being co-operable with one and another in the housing 302 and in cooperative communication with the hair dryer 100 to induce an inflow of unheated air into the housing and an outflow of heated air from the housing. The housing 302, much like the hair dryer housing 100, may be made out of a suitable metal or plastic. The housing 302 has opposite open inlet and outlet ends 306, 308 and a passageway extending between the open inlet and outlet ends. The spacing between the wall panels 200, 202 and the length of the housing 302 are such that its open inlet and outlet ends 306, 308 are locatable proximate the first and second openings 204, 206 in the respective wall panels. The term "wall panels" is used in the same generic sense as stated herein above (i.e. may be part of any type of wall structure or any type of movable or stationary cabinet or fixture).

Referring particularly now to FIG. 12, the housing 302 of the vent system 300 is configured to be mountable to and extendable between the wall panels 200, 202. The housing 302 includes a collar portion 338 that rests about a peripheral edge created by the opening 206 on wall panel 202. The outlet end 308 of the housing 302 extends outwardly until the collar portion 338 lies flush with outer wall surface of the wall panel 202, wherein a face panel 310 having a plurality of lateral slits having adjustable outwardly protruding members 312 (e.g. air grille) is fastened to the collar portion 338 at the outlet end 308 of the housing 302. Opposite the outlet end 308, a rectangular-shaped couple 340 is affixed to the inlet end 306 of the housing 302 securing the vent system 300 to the wall panels 200, 202.

An exemplary method on how the housing 302 may be disposed between the wall panels 200, 202 is as follows: first inserting the housing 302 at its outlet end 308 through the first opening 204 of the wall panel 200; second, moving the housing through the space between the wall panels 200, 202; and, third inserting the housing outlet end 308 into the second opening 206 of the other wall panel 202 until the collar portion 338 of the housing 302 is resting on the peripheral edge created by the opening 206 and flush with the outer surface of wall 202. Once the system has been disposed therein, the housing 302 may be secured to the wall panels 200, 202 by affixing the rectangular couple 340 to its inlet end 306 and affixing the vent face 310 to its outlet end 308.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A hair dryer mountable within a gap defined between spaced-apart first and second wall panels, each of said first and second wall panels having an interior surface and an oppositely-facing exterior surface, the first wall panel having a first wall panel aperture therethrough, the second wall panel having a second wall panel aperture therethrough, the hair dryer comprising:

a housing having a generally hollow cylindrical body defining an open inlet end, an opposite open outlet end, and a passageway extending therebetween, the open inlet end, open outlet end and passageway, all concentric about a housing central axis, the open outlet end defined by an annular flange, wherein, upon mounting said hair dryer to said spaced-apart first and second wall panels, the open inlet end of said housing is received through the second wall panel aperture, through the gap, and toward the first wall panel aperture until the housing annular flange frictionally engages the exterior surface of said second wall panel;

a group of co-operative components supported by said housing and in communication with said passageway, the group of components co-operable to induce an inflow of unheated air into said open inlet end of said housing, and to produce an outflow of heated air from said open outlet end of said housing; and an annular coupler having an internally-threaded annular body terminating at an annular coupler flange, the internally-threaded annular body threadably coupled to an externally-threaded exterior surface portion of said housing adjacent to said open inlet end, wherein, upon inserting the internally-threaded annular body through the first wall panel aperture and into said gap, and threadably coupling the internally-threaded annular body to the externally-threaded exterior surface portion at the open inlet end of said housing, the annular coupler flange frictionally-engages an area of the exterior surface of said first wall panel circumscribing said first wall panel aperture;

wherein, threading said annular coupler about the externally-threaded housing portion adjacent to said open inlet end of said housing draws the annular coupler flange and the housing annular flange toward one another and against the respective exterior surfaces of said first and second wall panels to securely mount said hair dryer to said first and second wall panels with said hair dryer housing suspended therebetween within said gap.

2. The hair dryer of claim 1 wherein the annular coupler flange extends radially outward from said annular body to define an annular planar surface for frictionally engaging the exterior surface of said first wall panel about said first wall panel aperture.

3. The hair dryer of claim 1 wherein the housing annular flange extends radially outward from the open outlet end of said housing to define an annular planar surface for frictionally engaging the exterior surface of said second wall panel about said second wall panel aperture.

4. The hair dryer of claim 1 further comprising an air ejection nozzle seated within and coupled to said open outlet end of said housing.

5. The hair dryer of claim 4, wherein said nozzle has a tapered outer portion that directs and concentrates the outflow of heated air from said nozzle.

6. The hair dryer of claim 4, wherein said nozzle and said open outlet end of said housing have complementary arcuate-shaped annular portions that permit said nozzle to be swiveled relative to said housing to vary the direction of outflow of heated air.

7. The hair dryer of claim 4, further comprising an adapter extension having an elongated flexible hose at one end configured to fit over said nozzle, and a head at an opposite end from said one end with a handle affixed thereto to facilitate maneuvering of said head and said flexible hose to enable drying the hair of a person.

8. The hair dryer of claim 1 wherein said group of co-operative components further comprises:

a rotary fan peripherally mounted to said housing; and a drive motor centrally and drivingly coupled to said rotary fan, said rotary fan and said drive motor together centrally located in said passageway of said housing.

9. The hair dryer of claim 8 wherein said group of co-operative components further comprises: a pair of electric heating coils located in said passageway of said housing.

10. The hair dryer of claim 9 wherein said group of co-operative components further comprises: a plurality of electrical components supplying electrical power to said drive motor and said pair of electric heating coils.

11. A dryer system mountable between spaced apart first and second wall panels, said dryer system comprising:

a first dryer including a housing having a hollow cylindrical configuration, opposite open inlet and outlet ends, and a passageway extending therebetween;

a group of co-operative components supported by said housing in communication with said passageway and being co-operable to induce an inflow of unheated air into said open inlet end of said housing and produce an outflow of heated air from said open outlet end of said housing;

an annular coupler comprising a male threaded section defined on said housing externally about said open inlet end thereof, and a rotatable annular flange having an annular body, an outer annular rim on said annular body capable of forming an abutting relationship with an exterior surface area of said first wall panel surrounding a first opening in said first wall panel, and a female threaded section formed internally on said annular body and configured to thread along said male threaded section on said open inlet end of said housing to bring said outer annular rim into said abutting relationship with said first wall panel;

an annular flange affixed to said housing at said open outlet end and configured to form an abutting relationship with an exterior surface area of said second wall panel surrounding a second opening in said second wall panel; and a hollow nozzle coupled to said open outlet end of said housing through which flows the outflow of heated air from said open outlet end of said housing, said nozzle and said open outlet end of said housing have complementary arcuate-shaped annular portions that permit said nozzle to be swiveled relative to said housing to vary the direction of outflow of heated air;

wherein threading said female threaded section of said annular coupler along said male threaded section of said open inlet end of said housing enables said annular coupler and said annular flange together to dispose and clamp said housing between and respectively to said first and second wall panels with said open inlet and outlet ends occupying the first opening of the first wall panel and the second opening of the second wall panel;

a second dryer including a housing having a hollow rectangular configuration, opposite open inlet and outlet ends, and a passageway extending therebetween;

a group of co-operative components supported by said housing in communication with said passageway and coupled to said co-operative components of said first dryer in an electrical relationship such that said co-operative components of said second dryer can induce an inflow of unheated air into said open inlet end of said housing and produce an outflow of heated air from said open outlet end of said second dryer simultaneously as said first dryer;

a rectangular coupler affixed to the exterior of said first wall panel surrounding the first opening therein and coupled to the open inlet of said second dryer housing; and a face panel having a plurality of spaced-apart adjustable airway passageways that permit said airway passageways to be swiveled relative to said face panel to vary the direction of outflow of heated air, and said face panel affixed to said outlet end portion of said housing of said second dryer.

12. The dryer system of claim 11 wherein said outer annular rim of said rotatable annular of flange of said first dryer extends radially outward from said annular body to define an annular planar surface that faces toward and is capable of forming said abutting relationship with the exterior surface of said first wall panel surrounding the first wall panel opening.

13. The dryer system of claim 11 wherein said annular flange of said first dryer extends radially outward from said open outlet end of said housing so as to form an annular planar surface that faces toward and is capable of forming said abutting relationship with the exterior of said second wall panel surrounding the second wall panel opening.

14. The dryer system of claim 11 wherein said group of co-operative components of said first dryer comprises:

a rotary fan peripherally mounted to said housing;

a drive motor centrally and drivingly coupled to said rotary impeller, said rotary fan and said drive motor together centrally located in said passageway of said housing;

a pair of electric heating coils respectively located in said passageway of said housing in spaced apart relationships between one of said opposite open inlet and outlet ends of said housing and a corresponding one of opposite faces of said rotary fan; and a plurality of electrical components supplying electrical power to said drive motor and pair of electric heating coils.

15. The dryer system of claim 11 wherein said group of co-operative components of said second dryer comprises:

at least one wire connecting said first dryer to said second dryer in parallel;

a rotary fan peripherally mounted to said housing;

a drive motor centrally and drivingly coupled to said rotary impeller, said rotary fan and said drive motor together centrally located in said passageway of said housing;

a pair of electric heating coils respectively located in said passageway of said housing in spaced apart relationships between one of said opposite open inlet and outlet ends of said housing and a corresponding one of opposite faces of said rotary fan; and a plurality of electrical components supplying electrical power to said drive motor and pair of electric heating coils.

16. The hair dryer of claim 11 further comprising an adapter extension having an elongated flexible hose at a first end thereof configured to fit over said nozzle, and a head at an opposite second end thereof to facilitate maneuvering of said head and said flexible hose to enable drying an individual user's hair.

17. A hair dryer mountable between spaced-apart first and second wall panels, said hair dryer comprising:

a housing having a hollow cylindrical configuration, opposite open inlet and outlet ends, and a passageway extending therebetween;

a group of co-operative components supported by said housing in communication with said passageway and being co-operable to induce an inflow of unheated air into said open inlet end of said housing and produce an outflow of heated air from said open outlet end of said housing;

an annular coupler comprising a male threaded section defined on an exterior surface of said housing about said open inlet end thereof, and a rotatable annular flange having an annular body, an outer annular rim on said annular body extending radially outward from said annular body so as to form an annular planar surface that faces toward and is capable of forming an abutting relationship with an exterior surface area of said first wall panel surrounding a first opening in the one wall panel opening, and a female threaded section formed internally on said annular body and configured to thread along said male threaded section on said open inlet end of said housing to bring said outer annular rim into said abutting relationship with said first wall panel;

an annular flange affixed at and extending radially outward from said open outlet end of said housing so as to form an annular planar surface that faces toward and is capable of forming an abutting relationship with an exterior surface area of said second wall panel surrounding the second wall panel opening;

a nozzle of a hollow configuration coupled to said open outlet end of said housing, through which flows the outflow of heated air from said open outlet end of said housing, said nozzle and said open outlet end of said housing having complementary arcuate-shaped annular portions that permit said nozzle to be swiveled relative to said housing to vary the direction of outflow of heated air; and an adapter extension having an elongated flexible hose at a first end thereof, configured to fit over said nozzle and a head at an opposite second end thereof to facilitate maneuvering of said head and said flexible hose to enable drying an individual's hair;

wherein threading said female threaded section of said annular coupler along said male threaded section of said open inlet end of said housing enables said annular coupler and said annular flange together to dispose and clamp said housing between and respectively to said first and second wall panels with said open inlet and outlet ends occupying the first wall panel opening and the second wall panel opening.

18. The hair dryer of claim 17 wherein said group of co-operative components comprises:

a rotary fan peripherally mounted to said housing;

a drive motor centrally and drivingly coupled to said rotary impeller, said rotary fan and said drive motor together centrally located in said passageway of said housing;

a pair of electric heating coils respectively located in said passageway of said housing in spaced apart relationships between one of said opposite open inlet and outlet ends of said housing and a corresponding one of opposite faces of said rotary fan; and a plurality of electrical components supplying electrical power to said drive motor and pair of electric heating coils.

* * * * *